US012129714B2

(12) United States Patent
Cassidy et al.

(10) Patent No.: US 12,129,714 B2
(45) Date of Patent: Oct. 29, 2024

(54) FIBER ELECTRIC WET MATE

(71) Applicant: Schlumberger Technology Corporation, Sugar Land, TX (US)

(72) Inventors: Christopher Cassidy, Pearland, TX (US); Julia Huynh, Houston, TX (US); Valeria Erives, Houston, TX (US); Pedro Bazan, Jr., Friendswood, TX (US); Thomas Evrard, Montmorency (FR); Surya Simanjuntak, Sugar Land, TX (US); Steve Wattelle, Clamart (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/261,308

(22) PCT Filed: Jan. 18, 2022

(86) PCT No.: PCT/US2022/012769
§ 371 (c)(1),
(2) Date: Jul. 13, 2023

(87) PCT Pub. No.: WO2022/155592
PCT Pub. Date: Jul. 21, 2022

(65) Prior Publication Data

US 2024/0076942 A1 Mar. 7, 2024

Related U.S. Application Data

(60) Provisional application No. 63/138,625, filed on Jan. 18, 2021.

(51) Int. Cl.
*E21B 17/02* (2006.01)

(52) U.S. Cl.
CPC ..... *E21B 17/02* (2013.01); *E21B 17/028* (2013.01); *E21B 17/0283* (2020.05)

(58) Field of Classification Search
CPC ..... E21B 17/0283; E21B 17/028; E21B 17/02
See application file for complete search history.

(56) References Cited

U.S. PATENT DOCUMENTS 7,252,437 B2 8/2007 Ringgenberg
7,398,822 B2 7/2008 Meijer
(Continued)

FOREIGN PATENT DOCUMENTS

WO 2016003390 A1 1/2016
WO 2017213726 A2 12/2017
WO 2021247726 A1 12/2021

OTHER PUBLICATIONS

Control Line Wetmate (CLWM), downloaded on Jul. 4, 2023, from link https://www.slb.com/ . . . /control-line-wet-mate-ps.ashx, (2 pages).

(Continued)

*Primary Examiner* — Brad Harcourt
(74) *Attorney, Agent, or Firm* — Jeffrey D. Frantz

(57) ABSTRACT

Systems and methods for monitoring and control in downhole well applications are provided. The system and methodology may be combined with a variety of completions or other types of well equipment deployed downhole to enable both electrical and fiber optic communication with downhole components. For example, the system enables both electrical and fiber optic communication for operating and monitoring of downhole completion systems or other systems.

17 Claims, 5 Drawing Sheets

(56) References Cited

U.S. PATENT DOCUMENTS

| | | | | |
|---|---|---|---|---|
| 7,503,395 | B2 | 3/2009 | Meijer et al. | |
| 7,510,003 | B2 | 3/2009 | Meijer | |
| 7,640,977 | B2 | 1/2010 | Jonas | |
| 7,798,212 | B2 | 9/2010 | Bolze et al. | |
| 7,806,190 | B2 | 10/2010 | Du | |
| 7,900,698 | B2 | 3/2011 | Stoesz | |
| 8,496,064 | B2 | 7/2013 | Du | |
| 8,752,635 | B2 | 6/2014 | Wang | |
| 9,000,873 | B2 | 4/2015 | Deville et al. | |
| 2007/0144746 | A1 | 6/2007 | Jonas | |
| 2008/0007425 | A1 | 1/2008 | Hall et al. | |
| 2009/0045146 | A1 | 2/2009 | Stoesz | |
| 2011/0017468 | A1 | 1/2011 | Birch | |
| 2011/0079400 | A1 | 4/2011 | Algeroy | |
| 2011/0192596 | A1 | 8/2011 | Patel | |
| 2016/0237803 | A1* | 8/2016 | Patel | E21B 33/13 |
| 2022/0333463 | A1* | 10/2022 | Steele | E21B 33/124 |

OTHER PUBLICATIONS

Hydraulic Line Wetmate (HLWM), downloaded on Jul. 4, 2023, from link https://www.slb.com/-/media/files/co/product-sheet/hlwm-ps (2 pages).

Hydraulic and Electric Wetmate (HEWM), downloaded on Jul. 4, 2023 from link https://www.slb.com/-/media/files/co/product-sheet/hewm-ps.ashx(2 pages).

International Search Report and Written Opinion issued in the PCT Application PCT/US2022/012769, dated May 13, 2022 (10 pages).

"SureCONNECT Downhole Intelligent Wet-Mate System", downloaded on May 21, 2023 from link https://www.bakerhughes.com/completions/well-monitoring-and-analytics/sureconnect-downhole-intelligent-wetmate-system (8 pages).

* cited by examiner

FIBER ELECTRIC WET MATE

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application is a National Stage of International Application No. PCT/US2022/012769, filed Jan. 18, 2022, which claims priority benefit of U.S. Provisional Application No. 63/138,625, filed Jan. 18, 2021, the entirety of each of which is incorporated by reference herein and should be considered part of this specification.

BACKGROUND

Field

The present disclosure generally relates to multi-stage completions and downhole connectors for use in oil and gas wells, and more particularly, to systems and methods for connecting multi-stage completions, for example, including, but not limited to, multi-stage completions including optical fibers.

Description of the Related Art

Many types of wells, e.g., oil and gas wells, are completed in multiple stages. For example, a lower stage of the completion, or lower completion assembly, is moved downhole on a running string. After deployment of the lower completion assembly at a desired location in the wellbore, an upper stage of the completion, or upper completion assembly, is deployed downhole and engaged with the lower completion assembly.

In many applications, it is desirable to instrument the lower completion with electrical or optical sensors or to provide for transmission of fluids to devices in the lower completion. For example, a fiber optic cable can be placed in the annulus between the screen and the open or cased hole. To enable communication of signals between the sensor in the lower completion and the surface or seabed, a wet-mate connection is needed between the upper and lower completion equipment.

SUMMARY

In some configurations, a downhole completion system includes a lower completion comprising a receptacle, a lower fiber optic wetmate connector, and a first component of an inductive coupler pair; and an upper completion comprising a stinger, an upper fiber optic wetmate connector, and a second component of an inductive coupler pair, the stinger configured to engage the receptacle, the upper fiber optic wetmate connector configured to couple to the lower fiber optic wetmate connector, and the first component of the inductive coupler pair configured to inductively couple to the second component of the inductive coupler pair.

The first component of the inductive coupler pair can be a female inductive coupler, and the second component of the inductive coupler pair can be a male inductive coupler.

When the stinger fully engages the receptacle, the inductive coupler can be positioned uphole of the fiber optic wetmate connectors. An electric cable extending downhole from the first component of the inductive coupler pair bypasses the lower fiber optic wetmate connector in the lower completion, and a fiber optic cable extending uphole from the upper fiber optic wetmate connector bypasses the second component of the inductive coupler pair in the upper completion. The second component of the inductive coupler pair can include a mandrel and one or more inductive coils mounted on the mandrel, the mandrel comprising a passageway extending axially through a body of the mandrel, wherein a fiber optic cable extending uphole from the upper fiber optic wetmate connector extends through the passageway. A bypass line or tube can be disposed within the passageway, and the fiber optic cable can extend through the bypass line or tube.

A portion of the upper completion can be configured to rotate during deployment to allow for rotational alignment of the upper and lower fiber optic wetmate connectors. The portion of the upper completion configured to rotate can be disposed uphole of the inductive coupler pair. The upper completion can be configured to house a fiber optic line extending uphole from the upper fiber optic wetmate connector and an upper electric line extending uphole from the second component of the inductive coupler pair in a coiled configuration to allow for rotation of the portion of the upper completion without tangling the fiber optic line and the upper electric line.

In some configurations, a system for use in a well includes a lower completion comprising a lower inductive coupler and a lower fiber optic wetmate connector; and an upper completion comprising an upper inductive coupler and an upper fiber optic wetmate connector, wherein upon engagement of the upper completion with the lower completion, the upper inductive coupler is configured to be operatively engaged with the lower inductive coupler and the upper fiber optic wetmate connector is configured to be operatively engaged with the lower fiber optic wetmate connector.

The lower inductive coupler can be a female inductive coupler, and the upper inductive coupler can be a male inductive coupler. Upon engagement of the upper and lower completions, the upper and lower inductive couplers can be positioned uphole of the fiber optic wetmate connectors. An electric cable extending downhole from the lower inductive coupler bypasses the lower fiber optic wetmate connector, and a fiber optic cable extending uphole from the upper fiber optic wetmate connector bypasses the upper inductive coupler in the upper completion. The upper inductive coupler can include a mandrel and one or more inductive coils mounted on the mandrel, the mandrel comprising a passageway extending axially through a body of the mandrel, wherein a fiber optic cable extending uphole from the upper fiber optic wetmate connector extends through the passageway. A bypass line or tube can be disposed within the passageway, and the fiber optic cable can extend through the bypass line or tube.

A portion of the upper completion can be configured to rotate during deployment to allow for rotational alignment of the upper and lower fiber optic wetmate connectors. The portion of the upper completion configured to rotate can be disposed uphole of the upper inductive coupler. The upper completion can be configured to house a fiber optic line extending uphole from the upper fiber optic wetmate connector and an upper electric line extending uphole from the upper inductive coupler in a coiled configuration to allow for rotation of the portion of the upper completion without tangling the fiber optic line and the upper electric line.

In some configurations, a method includes engaging an upper completion with a lower completion; and establishing electrical and fiber optic communication between the upper and lower completions.

Establishing electrical and fiber optic communication can include coupling an upper fiber optic wetmate connector of the upper completion with a lower fiber optic wetmate connector of the lower completion; and aligning and operatively coupling an upper inductive coupler of the upper completion with a lower inductive coupler of the lower completion.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

Figure 1:
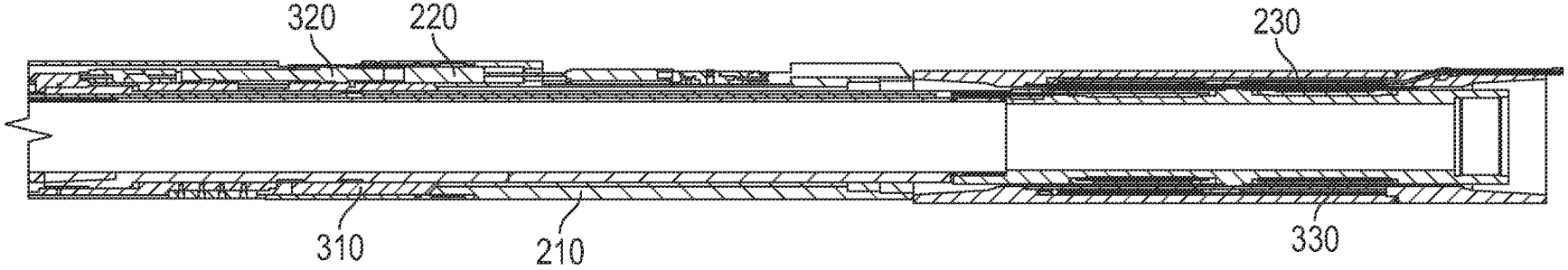
FIG. 1 illustrates an example fiber optic and electric downhole wetmate system.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Many types of wells, e.g., oil and gas wells, are completed in multiple stages. For example, a lower stage of the completion, or lower completion assembly, is moved downhole on a running string. After deployment of the lower completion assembly at a desired location in the wellbore, an upper stage of the completion, or upper completion assembly, is deployed downhole and engaged with the lower completion assembly.

Many well completions incorporate one or more control lines, such as optical, electrical, and/or hydraulic control lines, to carry signals to or from components of the downhole completion. For example, in many applications, it is desirable to instrument the lower completion with electrical or optical sensors or to provide for transmission of fluids to devices in the lower completion. To enable communication of signals between the sensor(s) in the lower completion and the surface or seabed, a wet-mate connection is needed between the upper and lower completion equipment. The completion of wells in two or more stages, however, can create difficulties in forming dependable and repeatable control line connections between adjacent completion assemblies.

The present disclosure provides systems and methods for connecting and providing communication between an upper completion and a lower completion. More specifically, the present disclosure provides systems and methods including a fiber optic connection and an inductive coupler. As used herein, "lower" can refer to a first or lead equipment/assembly moved downhole. "Upper" can refer to a second or later equipment/assembly moved downhole into engagement with the lower unit. In a horizontal wellbore, for example, the lower equipment/assembly is run downhole first prior to the upper equipment/assembly. Fiber optic electric wet mate systems and methods according to the present disclosure advantageously establish a fiber optic connection and electrical connection, and allow for fiber optic and electrical signal communication. The use of an inductive coupler to establish an electrical connection and allow for electrical signal communication advantageously removes the need for an electrical wetmate connector. Whereas electrical wetmate connectors can be unreliable, the inductive coupler provides a more reliable and preferred method of transmitted electrical signals.

In some configurations, systems and methods according to the present disclosure allow for deploying and connecting a fiber optic sensor network in a two-stage completion. In some configurations, the lower completion can be run with fiber, then the upper completion can be run with fiber, and the fiber of the upper completion and fiber of the lower completion can be mated via a connector. This can advantageously save time during deployment and installation as the fiber does not need to be pumped from the surface once a wetmate connection has been established. This configuration also enables fiber optics to be installed in multistage subsea deployments where the subsea tree is compatible with fiber optic cables, whereas fiber cannot be pumped in subsea installations as there is no continuous control line through a subsea tree. Once the connection is established, a continuous optical path is established from a surface location to the bottom of an open hole formation. In some configurations, systems and methods according to the present disclosure also allow for connecting other types of control lines and/or connectors, such as electrical control lines or connectors or fluid control lines or connectors. Different types of control lines and/or connectors, including fiber optic, electrical, and/or hydraulic control lines and/or connections, can be included in various combinations. The connections may be established, broken, and reestablished repeatedly.

Connection systems and methods according to the present disclosure may be used for land applications, offshore platform applications, or subsea deployments in a variety of environments and with a variety of downhole components. The systems and methods can be used to connect a variety of downhole control lines, including communication lines, power lines, electrical lines, fiber optic lines, hydraulic conduits, fluid communication lines, and other control lines. The connections can allow for the deployment of sensors, e.g., fiber optic sensors, in sand control components, perforating components, formation fracturing components, flow control components, or other components used in various well operations including well drilling operations, completion operations, maintenance operations, and/or production operations.

The upper and lower completion assemblies can include a variety of components and assemblies for multistage well operations, including completion assemblies, drilling assemblies, well testing assemblies, well intervention assemblies, production assemblies, and other assemblies used in various well operations. The upper and lower assemblies can include a variety of components depending on the application, including tubing, casing, liner hangers, formation isolation valves, safety valves, other well flow/control valves, perforating and other formation fracturing tools, well sealing elements, e.g., packers, polish bore receptacles, sand control components, e.g., sand screens and gravel packing tools, artificial lift mechanisms, e.g., electric submersible pumps or other pumps/gas lift valves and related accessories, drilling tools, bottom hole assemblies, diverter tools, running tools and other downhole components.

An example two-stage completion includes an upper completion and a lower completion. The upper completion can include a stinger, and the lower completion can include a receptacle. In use, the upper completion is run inside the lower completion, and the stinger engages the receptacle to complete a downhole connection.

Figure 2:
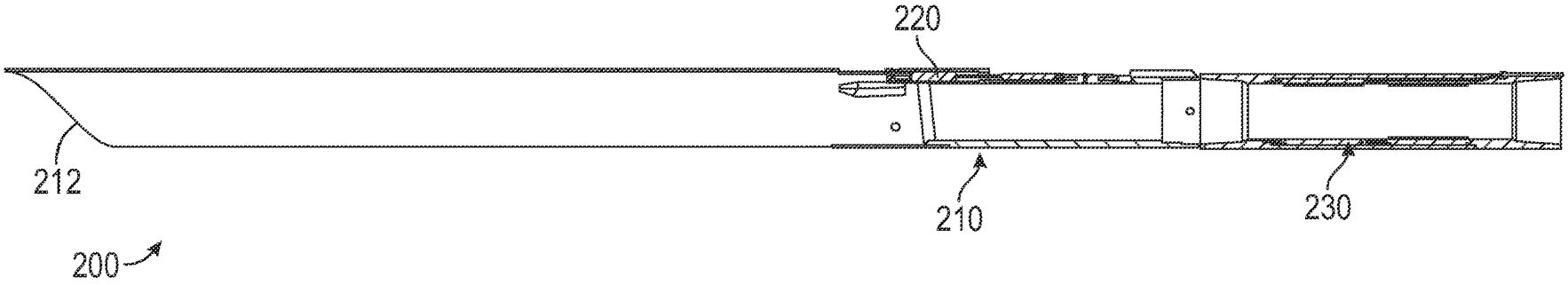
FIG. 2 illustrates a lower completion of a two-stage completion including the wetmate system of FIG. 1.
Figure 3:
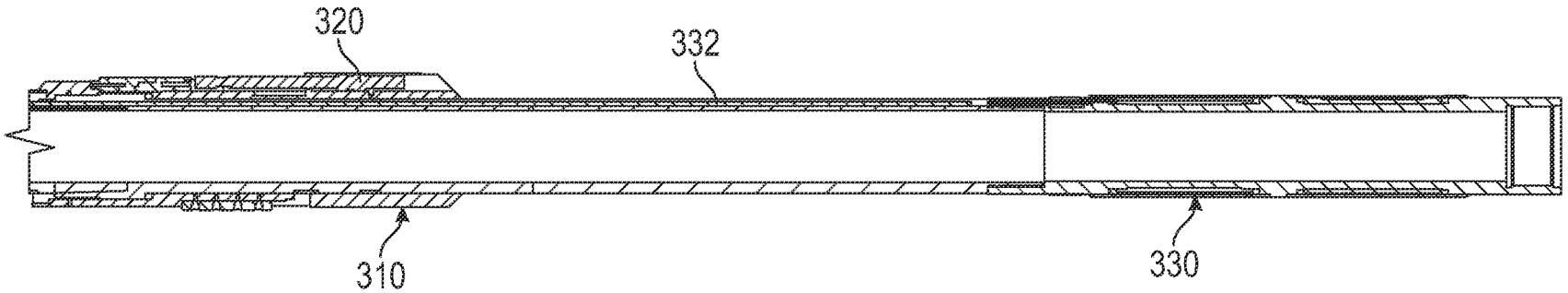
FIG. 3 illustrates an upper completion of the two-stage completion including the wetmate system of FIG. 1.

FIG. 1 shows an example downhole wetmate system, for example that can be included in a two-stage completion. The upper completion 300, for example, the stinger 310, can include one or more upper fiber optic wetmate connectors 320, as also shown in FIG. 3. The lower completion 200, for example, the receptacle 210, can include one or more lower fiber optic wetmate connectors 220, as also shown in FIG. 2. As shown, the upper completion 300 can also include a first (male in the illustrated configuration) component 330 of an inductive coupler pair, and the lower completion 200 can include a second (female in the illustrated configuration) component 230 of the inductive coupler pair.

In use, as the upper completion 300 is run in hole, the stinger 310 is lowered until a stinger key on the stinger 310 contacts or engages an alignment sleeve 212 of the receptacle 210. The alignment sleeve has a generally helical or curved profile. The stinger key rotates along the helix of the alignment sleeve 212 until the stinger key is clocked or aligned with a slot in the alignment sleeve 212. The upper completion 300 is then further lowered as the stinger key moves into and along the slot until the stinger 310 fully engages the receptacle 210. The upper fiber optic wetmate connectors 320 are then mated with the lower fiber optic wetmate connectors 220, as shown in FIG. 1. When the upper completion 300 (e.g., stinger 310) is engaged with the lower completion 200 (e.g., the receptacle 210), the first and second components 330, 230 of the inductive coupler pair are also aligned and inductively coupled.

The lower completion 200 includes fiber optic and electrical lines extending from the lower fiber optic wetmate connector(s) 220 and second component 230 of the inductive coupler pair, respectively, downhole to associated sensors, receivers, equipment and/or another downhole wetmate system. The upper completion 300 includes fiber optic lines and electrical lines 332 extending from the upper fiber optic wetmate connector(s) 320 and first component 330 of the inductive coupler pair, respectively, uphole to or towards the surface. The wetmate system, including fiber optic connectors and the inductive coupler pair, allows the transmission of fiber optic and electrical signals, respectively, through the upper and lower completions, for example, to, from, or between the surface and downhole sensors, receivers, and/or equipment.

In the configuration of FIGS. 1-3, the second component 230 of the inductive coupler pair is positioned below or downhole of the receptacle 210, as shown in FIG. 2. The fiber optic cable of the lower completion therefore bypasses the inductive coupler to continue downhole. In the illustrated configuration, the first component 330 of the inductive coupler pair is positioned below the stinger 310 and upper fiber optic wetmate connector(s) 320, as shown in FIG. 3. The electrical cable 332 extending from the first component 330 therefore bypasses the stinger 310 to continue uphole. When the upper completion 300 is engaged with the lower completion 200, the inductive coupler pair is positioned below or downhole of the fiber optic wetmate connection, as shown in FIG. 1.

Figure 4:
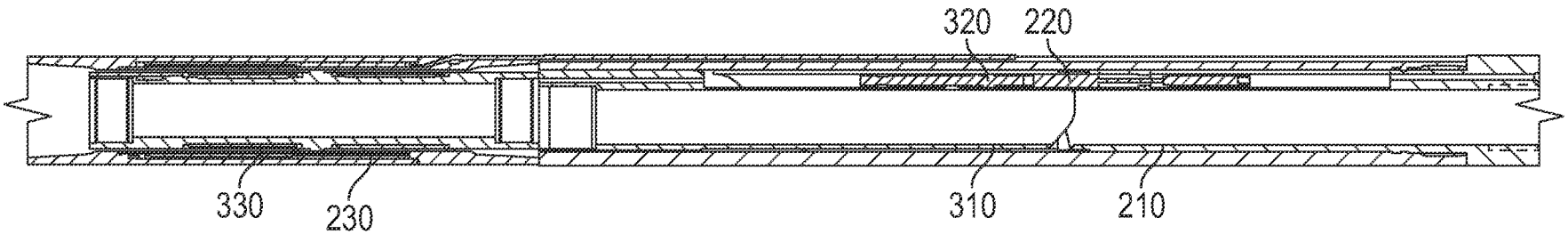
FIG. 4 illustrates another example fiber optic and electric downhole wetmate system.

FIG. 4 illustrates an alternative configuration in which the inductive coupler pair is positioned above or uphole of the fiber optic wetmate connection. In this configuration, the electric cable bypasses the fiber optic receptacle in the lower completion, and the fiber optic cable bypasses the inductive coupler in the upper completion.

Figure 5:
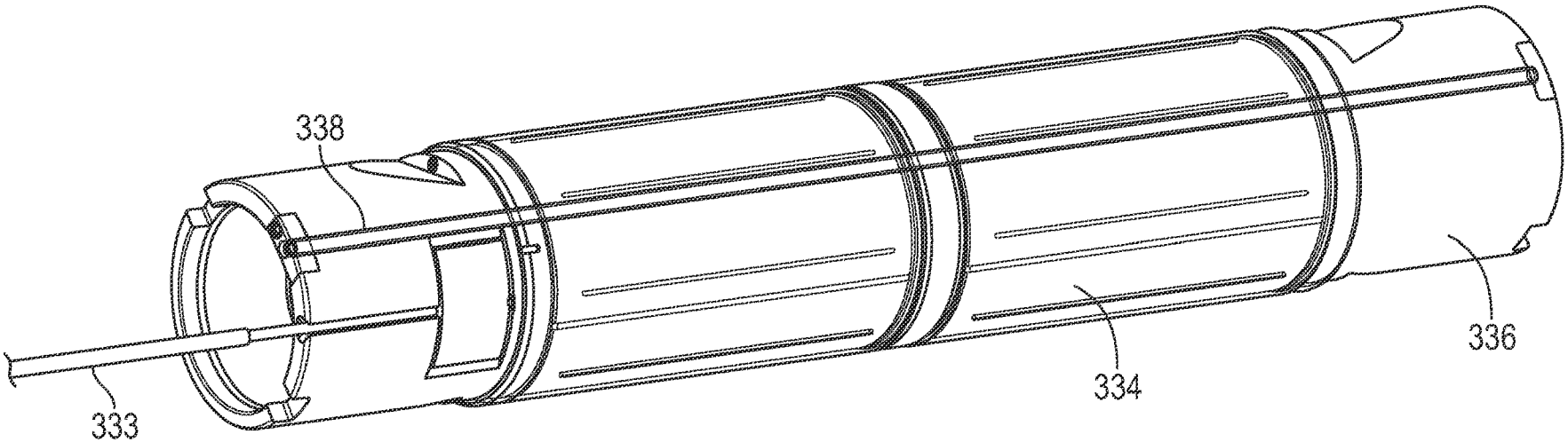
FIG. 5 illustrates an example male inductive coupler of the fiber optic and electric downhole wetmate system of FIG. 4.
Figure 6A:
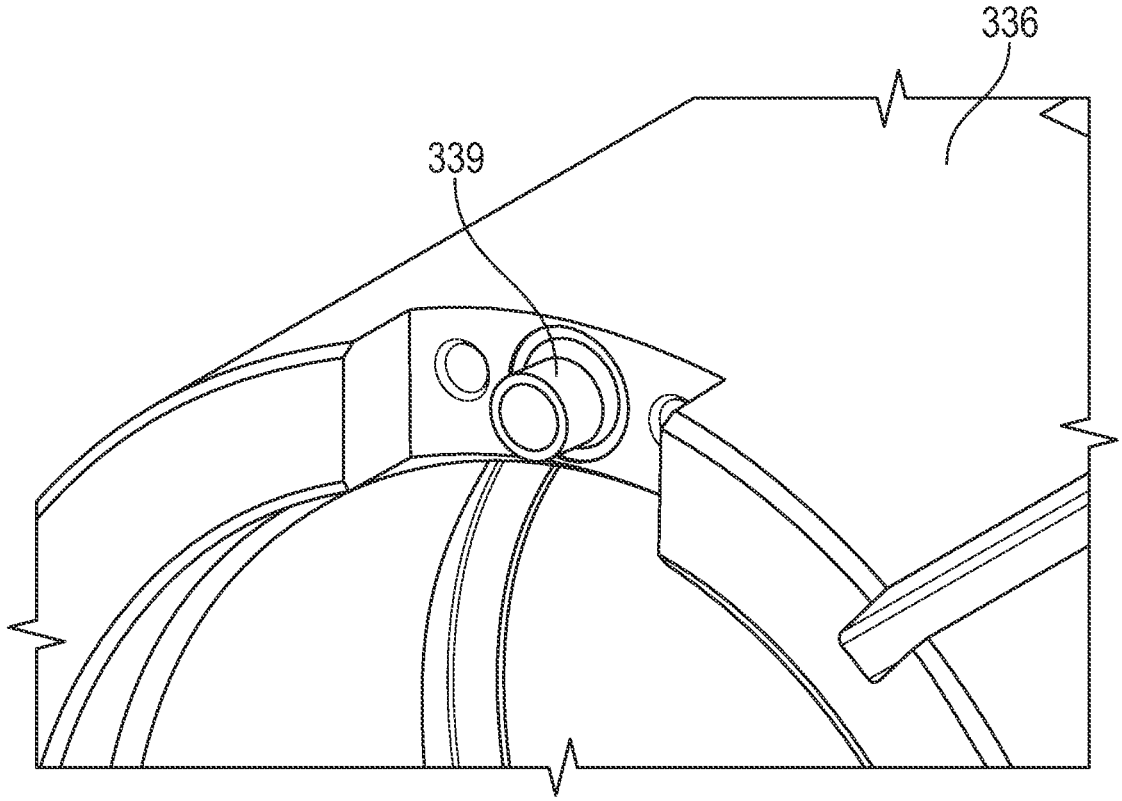
FIGS. 6A and 6B illustrate views of a portion of a mandrel of the male inductive coupler of FIG. 5.
Figure 6B:
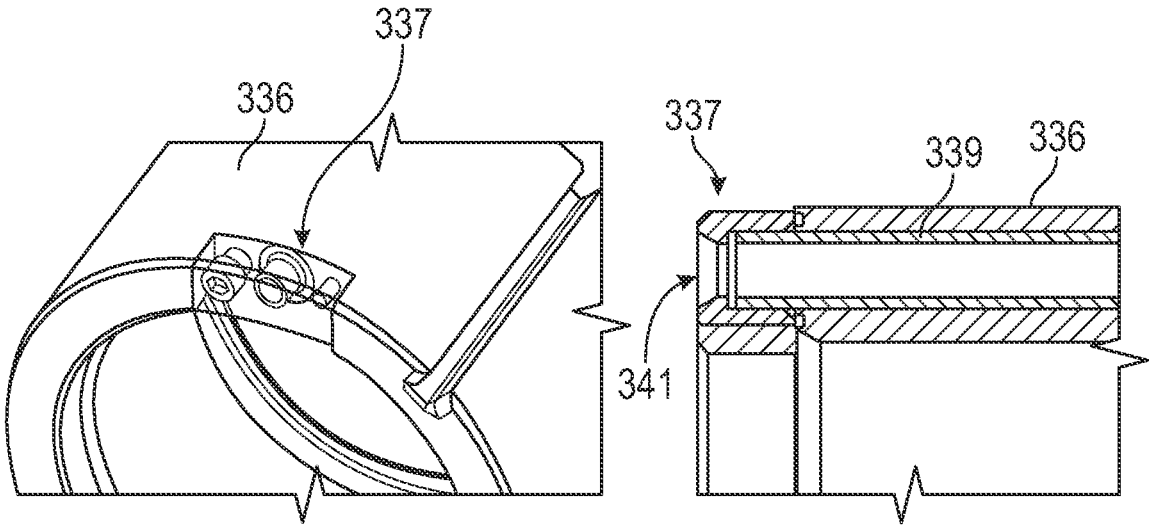

FIG. 5 illustrates an example male inductive coupler designed to allow the fiber optic cable to bypass the male inductive coupler 330 in the upper completion 300. The coupler of FIG. 5 can therefore be used in the wetmate system configuration shown in FIG. 4. As shown, the male inductive coupler 330 includes one or more inductive coils 334 mounted on or about a mandrel 336. The mandrel 336 has a body defining a central bore therethrough. An electric line 333 extends upward or uphole from the coil(s) 334. A passageway 338 is formed in the body of the mandrel 336 and extends axially through the mandrel 336. In some configurations, the passageway 338 receives a bypass line 339, for example as shown in FIGS. 6A-6B. The passageway 338 and/or the bypass line 339 receives the fiber optic cable such that the fiber optic cable of the upper completion extends upward or uphole from the upper fiber optic wetmate connector 320 through the passageway 338 and/or bypass line 339. As shown in FIG. 6A, the bypass line 339 can be welded to the mandrel 336 at or near one or both axial end(s) of the mandrel 336. A protector 337 can cover and protect one or both axial end(s) of the bypass line 339 as shown in FIG. 6B. The protector 337 can include a central opening 341 to allow the fiber optic cable to exit the protector 337.

Figure 7:
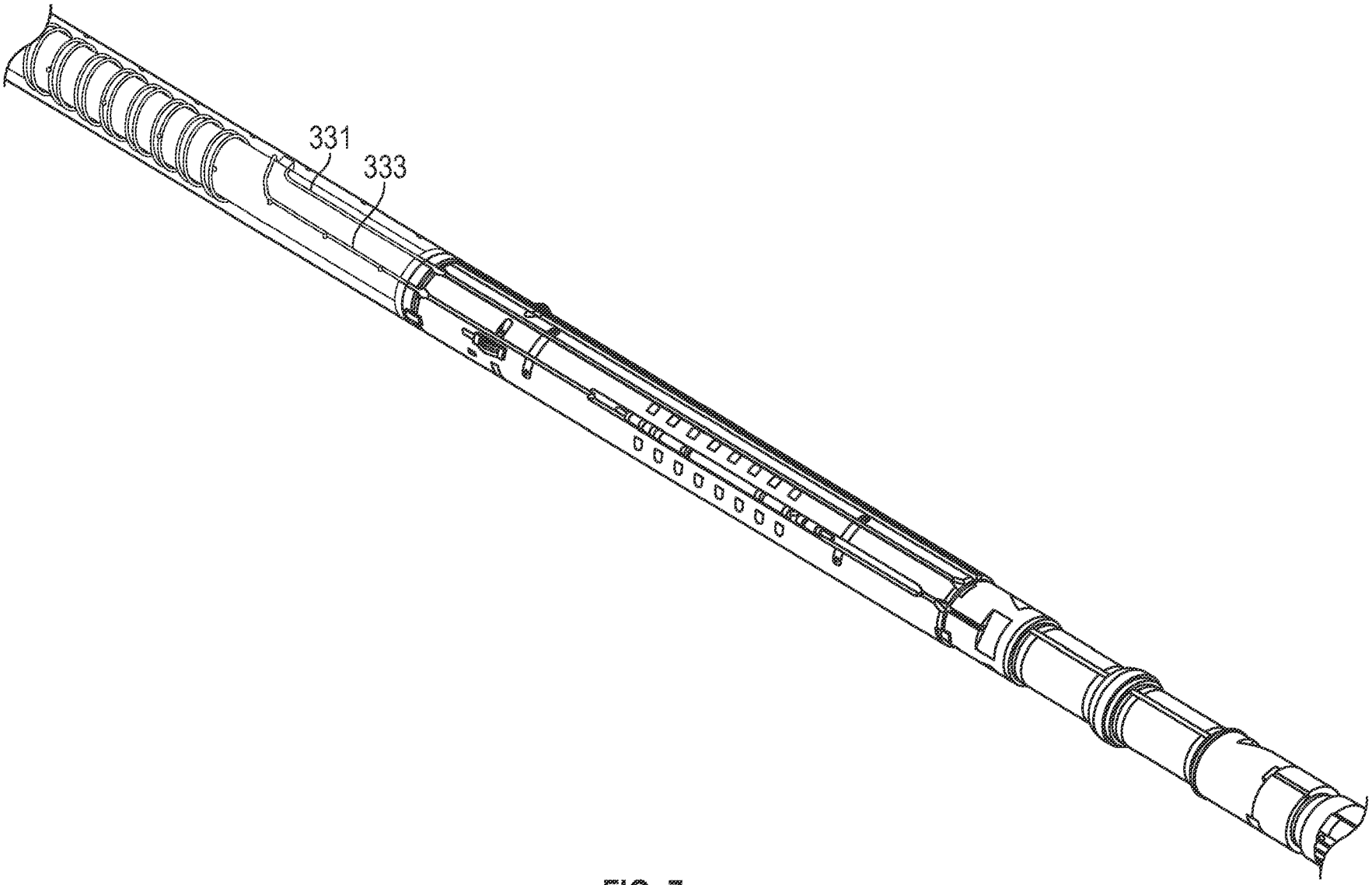
FIG. 7 illustrates an example upper completion of a two-stage completion including a fiber optic and electric wetmate system.

As described herein, during installation, the stinger 310 rotates relative to the receptacle 210 to properly align the upper 320 and lower 220 fiber optic wetmate connectors. To ensure proper axial alignment of the inductive coupler components 230, 330, the inductive coupler components 230, 330 may be disposed as axially close to the wetmate connectors 220, 320 as possible. In such a configuration, components of the stinger 310 that swivel to allow for rotational alignment with the receptacle 210 are positioned above or uphole of the inductive coupler pair. A portion of the stinger 310 or upper completion 300 can therefore house the upper fiber optic line 331 and/or upper electric line 333 in a coiled configuration to allow for this rotation without tangling the line(s), for example as shown in FIG. 7.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A system for use in a well, the system comprising:

a lower completion comprising a lower inductive coupler and a lower fiber optic wetmate connector; and an upper completion comprising an upper inductive coupler and an upper fiber optic wetmate connector, wherein upon engagement of the upper completion with the lower completion, the upper inductive coupler is configured to be operatively engaged with the lower inductive coupler and the upper fiber optic wetmate connector is configured to be operatively engaged with the lower fiber optic wetmate connector, wherein upon engagement of the upper and lower completions, the upper and lower inductive couplers are positioned uphole of the upper and lower fiber optic wetmate connectors, and wherein an electric cable extending downhole from the lower inductive coupler bypasses the lower fiber optic wetmate connector, and a fiber optic cable extending uphole from the upper fiber optic wetmate connector bypasses the upper inductive coupler in the upper completion.

2. The system of claim 1, wherein the lower inductive coupler comprises a female inductive coupler and the upper inductive coupler comprises a male inductive coupler.

3. The system of claim 1, wherein the upper inductive coupler comprising comprises a mandrel and one or more inductive coils mounted on the mandrel, the mandrel comprising a passageway extending axially through a body of the mandrel, wherein the fiber optic cable extending uphole from the upper fiber optic wetmate connector extends through the passageway.

4. The system of claim 3, further comprising a bypass line or tube disposed within the passageway, the fiber optic cable extending through the bypass line or tube.

5. The system of claim 1, wherein a portion of the upper completion is configured to rotate during deployment to allow for rotational alignment of the upper and lower fiber optic wetmate connectors.

6. The system of claim 5, wherein the portion of the upper completion configured to rotate is disposed uphole of the upper inductive coupler.

7. The system of claim 5, wherein the upper completion is configured to house the fiber optic cable extending uphole from the upper fiber optic wetmate connector and an upper electric line extending uphole from the upper inductive coupler in a coiled configuration to allow for rotation of the portion of the upper completion without tangling the fiber optic cable and the upper electric line.

8. A system for use in a well, the system comprising:

a lower completion comprising a lower inductive coupler and a lower fiber optic wetmate connector;

an upper completion comprising an upper inductive coupler and an upper fiber optic wetmate connector, wherein the upper inductive coupler comprises a mandrel and one or more inductive coils mounted on the mandrel, the mandrel comprising a passageway extending axially through a body of the mandrel, wherein a fiber optic cable extending uphole from the upper fiber optic wetmate connector extends through the passageway; and a bypass line or tube disposed within the passageway, the fiber optic cable extending through the bypass line or tube, wherein upon engagement of the upper completion with the lower completion, the upper inductive coupler is configured to be operatively engaged with the lower inductive coupler and the upper fiber optic wetmate connector is configured to be operatively engaged with the lower fiber optic wetmate connector, and wherein upon engagement of the upper and lower completions, the upper and lower inductive couplers are positioned uphole of the fiber optic wetmate connectors.

9. The system of claim 8, wherein the lower inductive coupler comprises a female inductive coupler and the upper inductive coupler comprises a male inductive coupler.

10. The system of claim 8, wherein a portion of the upper completion is configured to rotate during deployment to allow for rotational alignment of the upper and lower fiber optic wetmate connectors.

11. The system of claim 10, wherein the portion of the upper completion configured to rotate is disposed uphole of the upper inductive coupler.

12. The system of claim 10, wherein the upper completion is configured to house the fiber optic cable extending uphole from the upper fiber optic wetmate connector and an upper electric line extending uphole from the upper inductive coupler in a coiled configuration to allow for rotation of the portion of the upper completion without tangling the fiber optic cable and the upper electric line.

13. A system for use in a well, the system comprising:

a lower completion comprising a lower inductive coupler and a lower fiber optic wetmate connector; and an upper completion comprising an upper inductive coupler and an upper fiber optic wetmate connector, wherein upon engagement of the upper completion with the lower completion, the upper inductive coupler is configured to be operatively engaged with the lower inductive coupler and the upper fiber optic wetmate connector is configured to be operatively engaged with the lower fiber optic wetmate connector, wherein upon engagement of the upper and lower completions, the upper and lower inductive couplers are positioned uphole of the fiber optic wetmate connectors, and wherein a portion of the upper completion is configured to rotate during deployment to allow for rotational alignment of the upper and lower fiber optic wetmate connectors.

14. The system of claim 13, wherein the portion of the upper completion configured to rotate is disposed uphole of the upper inductive coupler.

15. The system of claim 13, wherein the upper completion is configured to house a fiber optic line extending uphole from the upper fiber optic wetmate connector and an upper electric line extending uphole from the upper inductive coupler in a coiled configuration to allow for the rotation of the portion of the upper completion without tangling the fiber optic line and the upper electric line.

16. The system of claim 13, wherein the lower inductive coupler comprises a female inductive coupler and the upper inductive coupler comprises a male inductive coupler.

17. The system of claim 13, wherein the upper inductive coupler comprises a mandrel and one or more inductive coils mounted on the mandrel, the mandrel comprising a passageway extending axially through a body of the mandrel, wherein a fiber optic cable extending uphole from the upper fiber optic wetmate connector extends through the passageway.

* * * * *